US005561887A

United States Patent [19]

Neag et al.

[11] Patent Number: 5,561,887

[45] Date of Patent: Oct. 8, 1996

[54] VEHICLE DOUBLE PIVOT DOOR HINGE ARRANGEMENT

[75] Inventors: Dorinel Neag, Commerce Township; Richard Hulbert, West Bloomfield, both of Mich.

[73] Assignee: Chrysler Corporation, Highland Park, Mich.

[21] Appl. No.: 438,115

[22] Filed: May 8, 1995

[51] Int. Cl.[6] ..... E05D 11/10

[52] U.S. Cl. ..... 16/334; 16/366

[58] Field of Search ..... 16/334, 329, 330, 16/331, 232, 366, 344, 348, 371

[56] References Cited

U.S. PATENT DOCUMENTS

| | | | |
|---|---|---|---|
| 1,065,406 | 6/1913 | Swinford . | |
| 1,735,696 | 11/1929 | Ridley . | |
| 2,372,431 | 3/1945 | Kahle . | |
| 3,431,588 | 3/1969 | Frey | 16/334 |
| 3,619,853 | 11/1971 | Merrill . | |
| 4,470,170 | 9/1984 | Gerteis | 16/334 |
| 4,641,881 | 2/1987 | Nomura et al. . | |
| 4,655,499 | 4/1987 | Piper . | |
| 4,672,715 | 6/1987 | Beckwith | 16/334 |
| 4,719,665 | 1/1988 | Bell . | |
| 4,928,350 | 5/1990 | Morgan . | |
| 5,054,165 | 10/1991 | Marchione . | |
| 5,452,501 | 1/1995 | Kramer et al. | 16/334 |

FOREIGN PATENT DOCUMENTS 3023637 1/1981 Germany .

*Primary Examiner*—Chuck Y. Mah
*Attorney, Agent, or Firm*—Thomas G. Pasternak

[57] ABSTRACT

A double pivot hinge assembly for attaching a door to a vehicle body door frame for swinging the door between closed, intermediate open, and full open positions in a self-latching and unlatching uninterrupted manner. The hinge assembly includes a U-shaped link having a bight portion and first and second legs extending therefrom wherein a first pin pivotally connects a body hinge to a free end of the first leg and a second pin pivotally connects a door hinge to a free end of the second leg. The door and body hinges are each formed with a sector plate providing a horizontal raceway such that the body and door hinges are interchangeable except for the location of the detent pocket. Each link leg has a resilient detent member juxtaposed its associated raceway adapted for biased travel on a predetermined raceway arcuate path for releasable self-latching engagement at a predetermined position of the door with an associated detent pocket. Each leg distal end has an ear intermeshed with upper and lower ears on its associated hinge leaf edge. The leaf ears define blocking surfaces adapted for contact with associated link stop faces providing predetermined door travel.

17 Claims, 6 Drawing Sheets

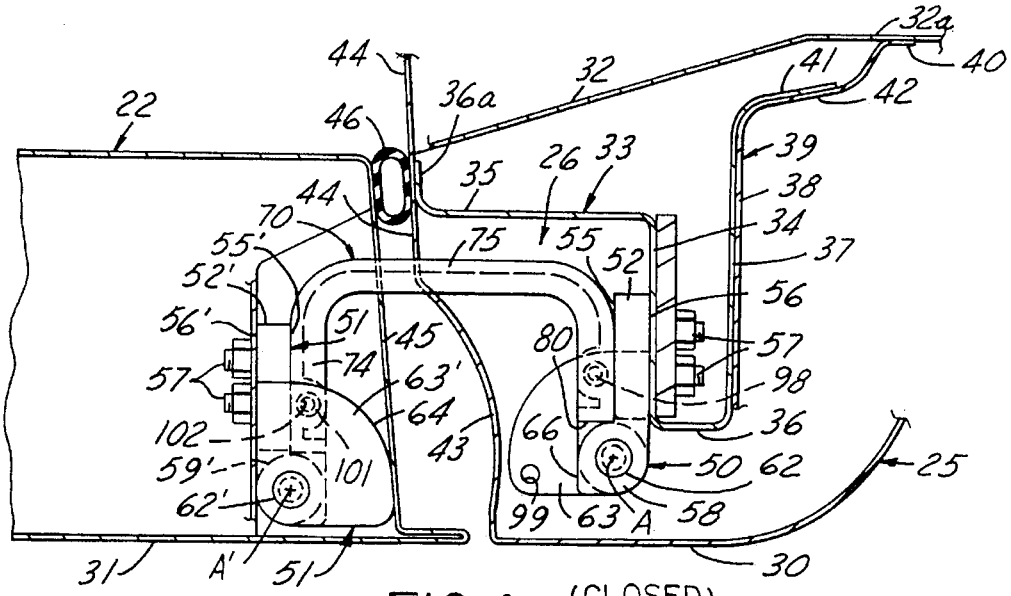
FIG.4 (CLOSED)
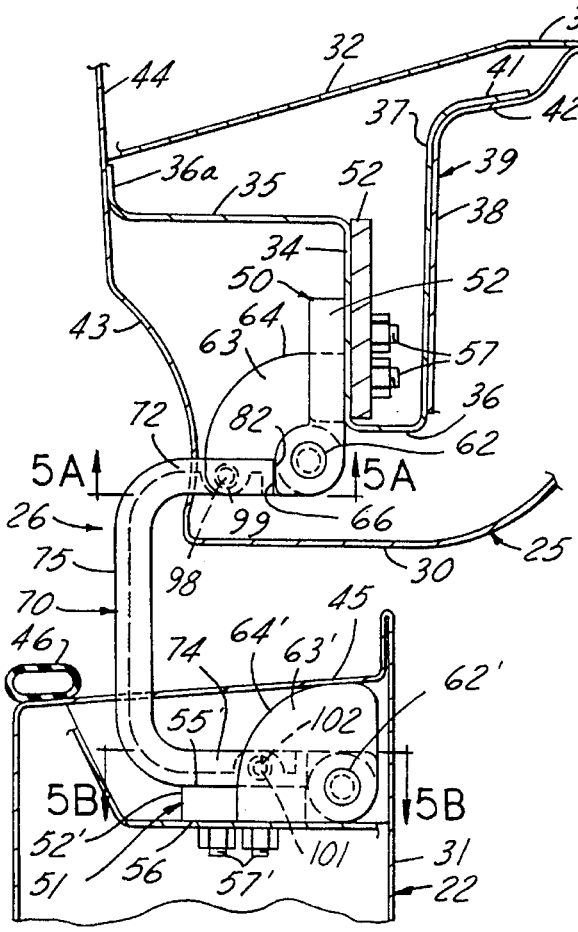
FIG.5 (OPEN 90°)
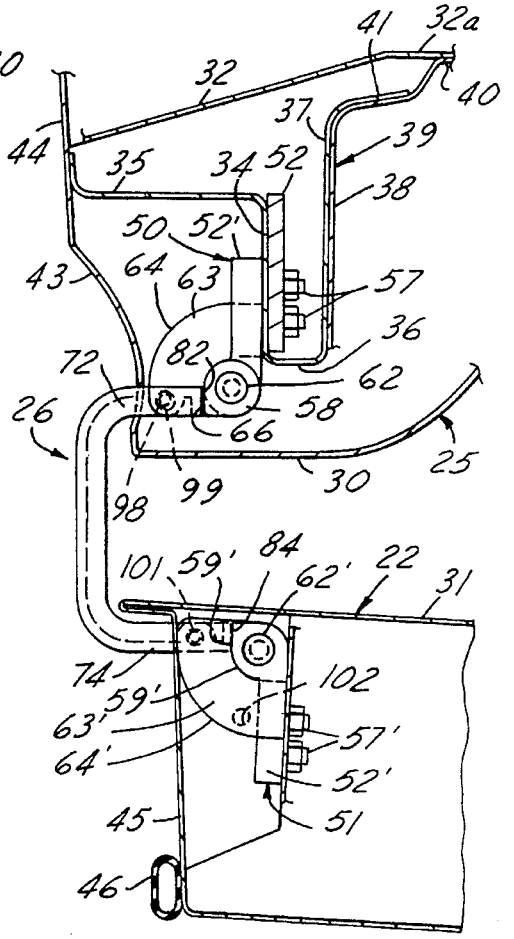
FIG.6 (OPEN 180°)

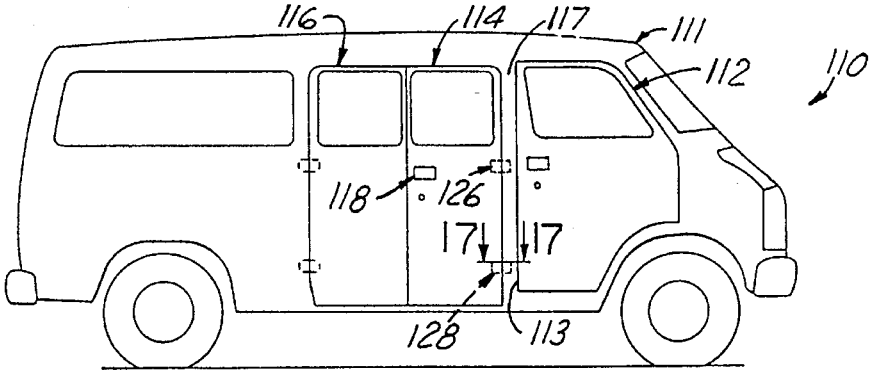
FIG.16
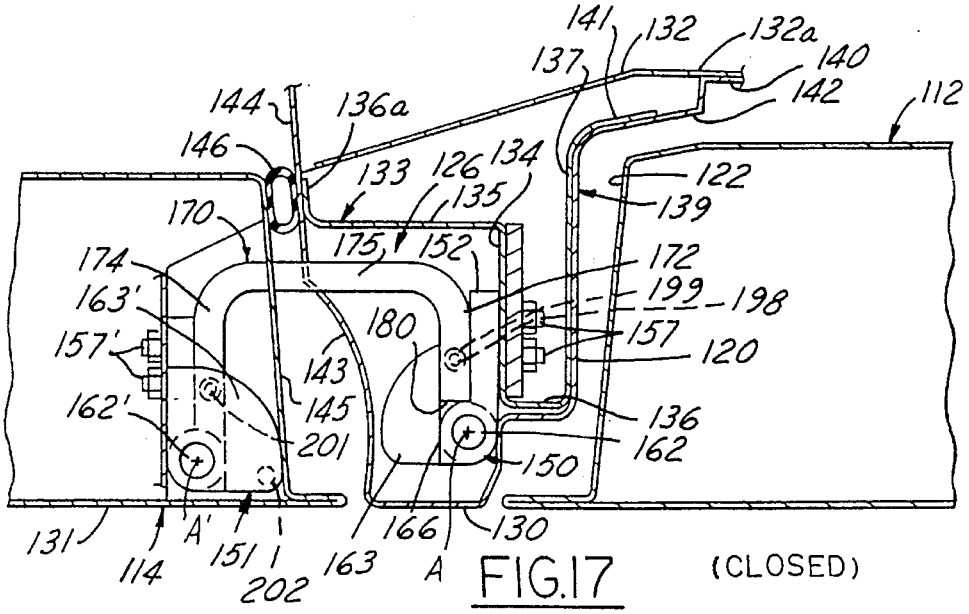
FIG.17 (CLOSED)
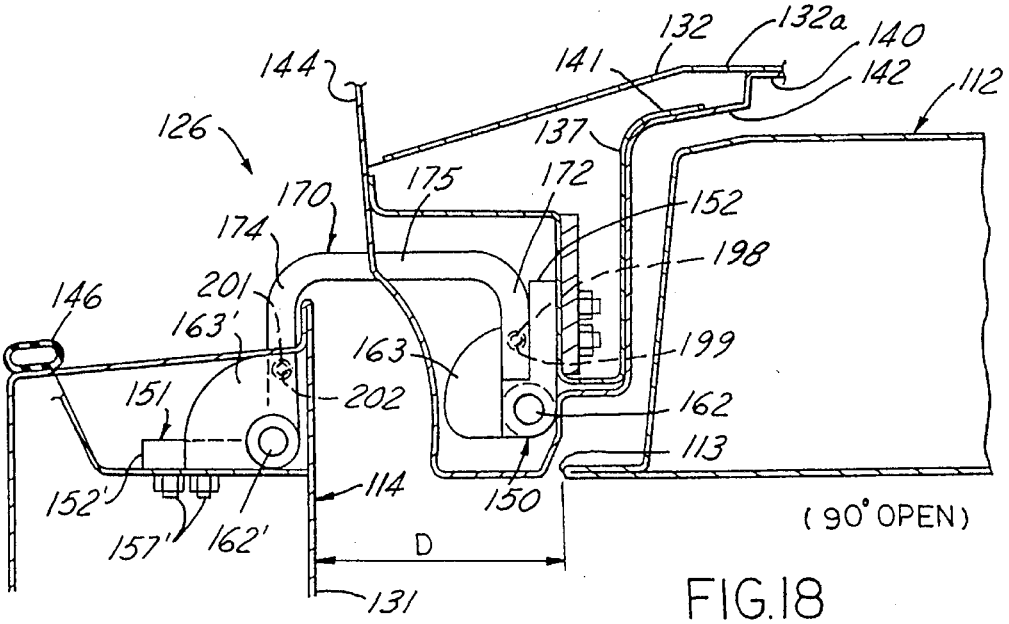
(90° OPEN)
FIG.18

(180° OPEN)

VEHICLE DOUBLE PIVOT DOOR HINGE ARRANGEMENT

BACKGROUND OF THE INVENTION

This invention relates to vehicle door hinges, and more particularly to a double pivot recessed hinge assembly for readily moving a door between closed, intermediate hold-open, and full hold-open positions in a self-latching and self-unlatching uninterrupted manner.

Various double pivot hinge arrangements have been patented for vehicle doors operative to position the doors in various hold-open positions. An example of one such double pivot hinge arrangement is shown in the U.S. Pat. No. 4,719,665 issued Jan. 19, 1988 to Bell. The Bell patent discloses a double pivot hinge providing first and second latch means alternately movable between latched, and unlatched positions to either latch the hinge arm to the door mounted hinge butt for movement of the door and hinge arms as a unit to the 90 degree open position or to latch the hinge arm to the vehicle mounted hinge butt for movement of the door relative to the hinge arm between 90 degree and 180 degree open positions. A detent means detents the first latch means in unlatched position during movement of the door between 90 and 180 degree open positions. The detent means is automatically released as the door moves from the 180 position to a position immediately adjacent the 90 degree open position to permit uninterrupted closing movement of the door.

U.S. Pat. No. 4,655,499 issued Apr. 7, 1987, to Piper entitled Door Hinge For Vehicle discloses a hinge mechanism connecting the vehicle door to the door frame. The hinge mechanism includes a bracket member having first and second ends and a first support bracket for supporting the first end from a door frame by a pin member and a second support bracket for supporting the second end from a door by a second pin member. The invention is characterized by including a hinge latching mechanism for reversibly latching one of the first and second ends of the bracket member from pivoting movement relative to the respective one of the first and second support brackets.

U.S. Pat. No. 4,928,350 issued May 29, 1990, to Morgan entitled Multiple Axis Hidden Hinge discloses a hinge construction of two mounting plates and a substantially U-shaped center link which connects the axes of pivot of the two plates. The link and plates contain stop mechanisms which determine their respective limits of pivot. In addition, the hinge contains a means for restraining the rotation of only one of the mounting plates around its corresponding link arm to insure a pattern of motion that is always consistent, and allows for the hinge to be mounted with a very narrow gap between the members being joined.

SUMMARY OF THE INVENTION

Accordingly, it is a feature of the present invention to provide a double pivot vehicle hinge assembly for a vehicle body enabling a vehicle door to be moved between closed, intermediate open, and full open positions in a self-latching and self-unlatching uninterrupted manner.

It is another feature of the present invention to provide a double pivot vehicle hinge assembly as set forth above wherein each hinge assembly includes a U-shaped hinge link having a bight portion and first and second parallel legs extending therefrom with a first leg incorporating a downwardly acting resilient latch detent member and a second leg incorporating an upwardly acting resilient latch detent member. The detent members are adapted for latching and unlatching engagement with an associated body hinge and a door hinge respectively, wherein each body and door hinge is adapted for pivotal contact with an associated link leg.

It is another feature of the present invention to provide a double pivot vehicle hinge assembly as set forth above wherein the hinge assembly further includes a first hinge pin pivotally connecting a body hinge to a distal end of an associated one link leg and a second hinge pin pivotally connecting a door hinge to a distal end of the other link leg, and wherein each leg has a resilient detent member.

It is still another feature of the present invention to provide a double pivot vehicle door hinge assembly wherein each body and door hinge includes a horizontally disposed sector plate with each sector plate having its center of curvature aligned on its associated hinge pivot pin vertical axis. Each sector plate defines a raceway formed with a detent pocket adapted upon predetermined relative rotation between one link leg and its hinge about their common pivot axis to a closed, intermediate open, and full open position, the hinge detent pocket is adapted to cooperate with a resilient detent member of the link leg in a predetermined latching and unlatching sequence.

It is still another feature of the present invention to provide a body hinge leaf with upper and lower ears each formed with a blocking surface. The pair of blocking surfaces define a common vertical plane in parallel offset relation to their associated leaf face. Further, one hinge associated link leg free end includes an upper and a lower stop face with each stop face adapted to contact an associated hinge upper or lower blocking surface upon predetermined relative rotation about one common pivot pin thereby positively limiting door full-open rotation obviating the door contacting exterior design surfaces of the vehicle body.

These and other features and advantages of the invention will be more fully understood from the following detailed description of the invention taken together with the accompanying drawings.

BRIEF DESCRIPTION OF THE DRAWINGS

In the drawings:

FIG. 4 is an enlarged horizontal sectional view taken substantially on the line 4—4 of FIG. 1 showing the upper hinge assembly in the door closed position;

FIG. 5 is a view similar to FIG. 4 showing the upper hinge assembly in the door intermediate open position;

Figure 5A:
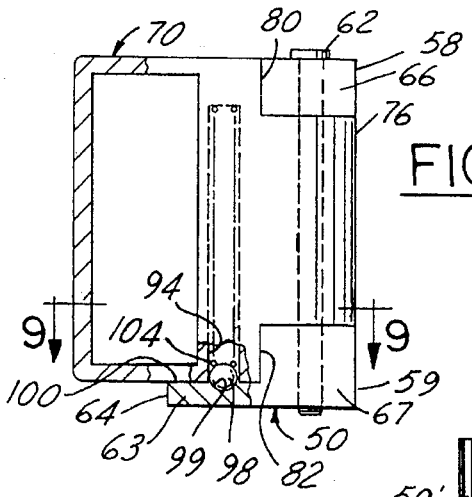
FIG. 5A is a vertical sectional view taken on the line 5A—5A of FIG. 5.
Figure 5B:
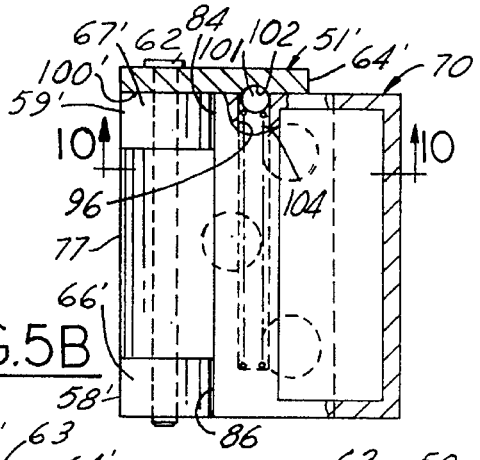
FIG. 5B is a vertical sectional view taken on the line 5B—5B of FIG. 5.
Figure 15:
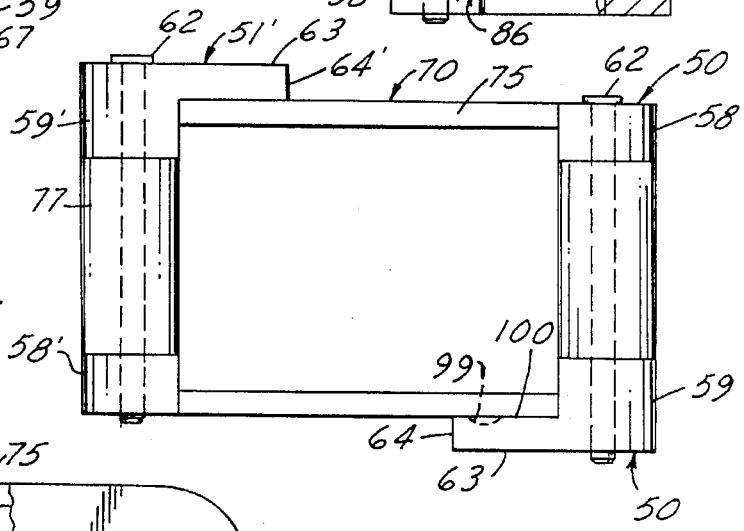
Figure 12:
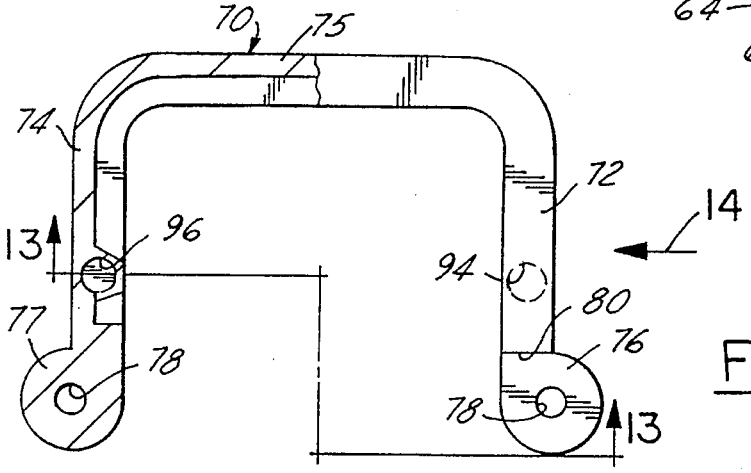
Figure 13:
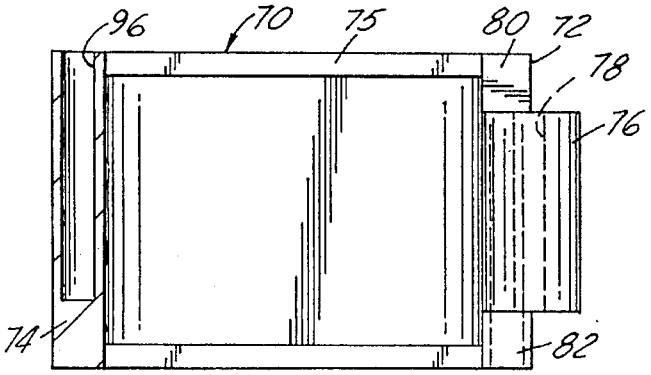
Figure 14:
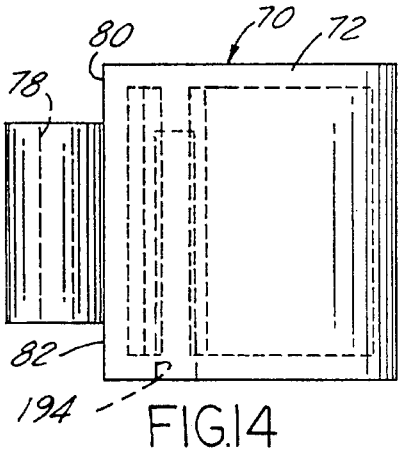
Figure 7:
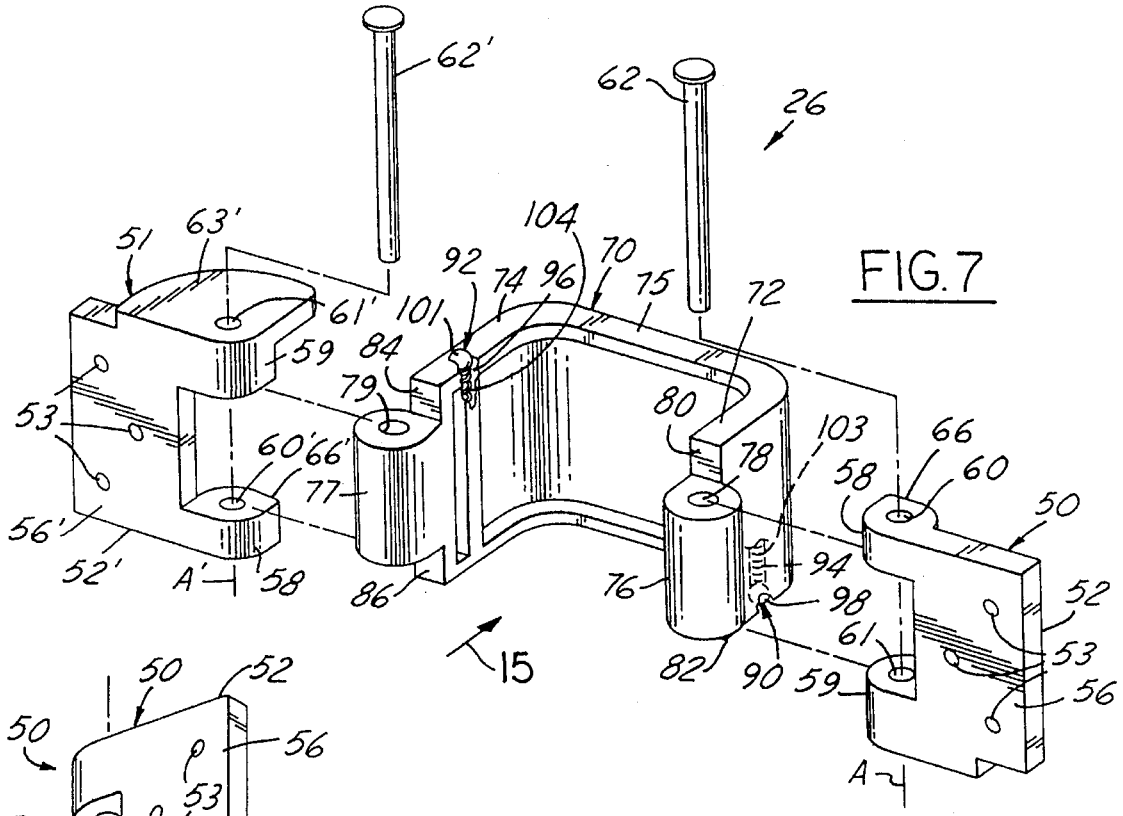
Figure 7A:
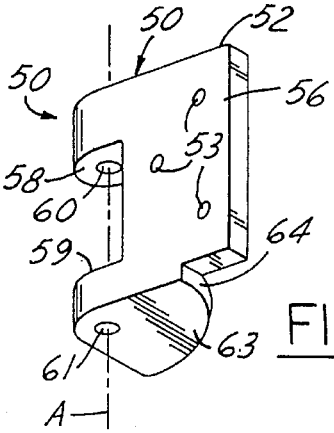
Figure 8:
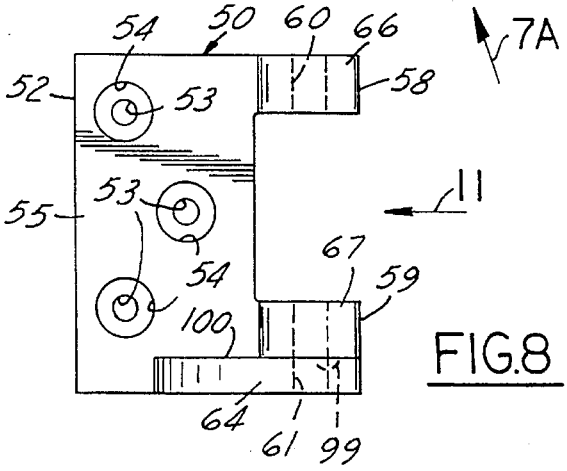
Figure 9:
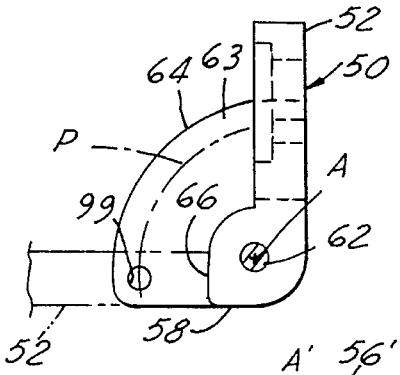
Figure 10:
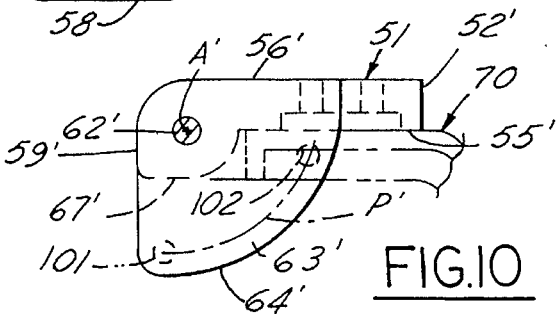
Figure 11:
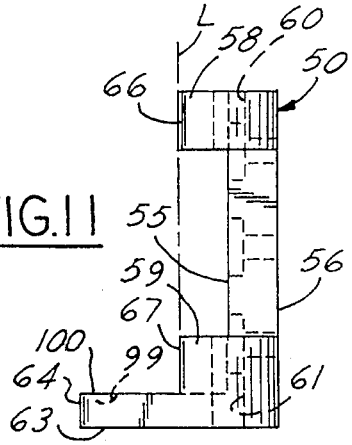
Figure 19:
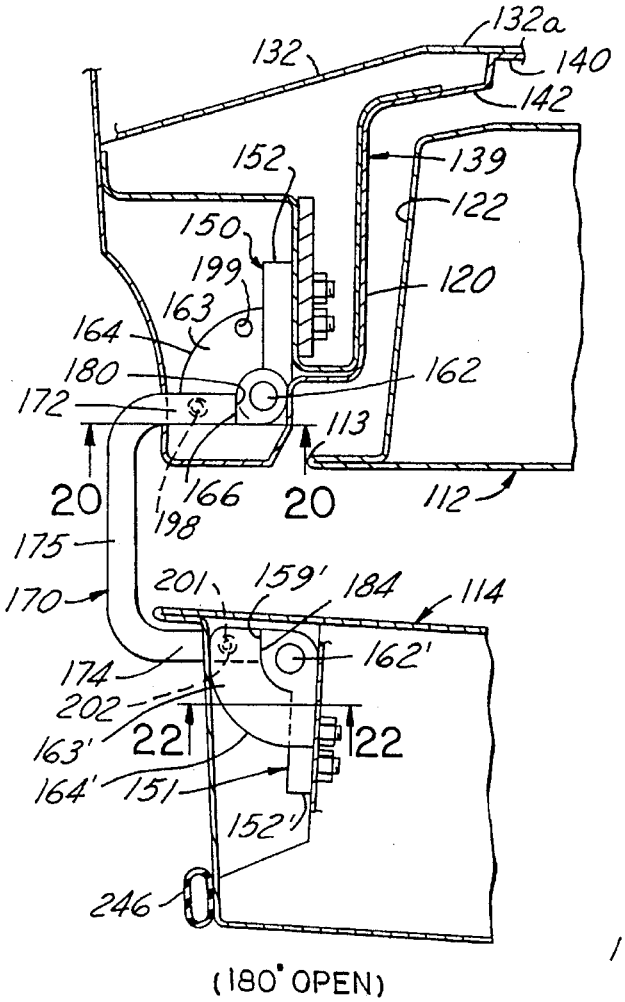
Figure 21A:
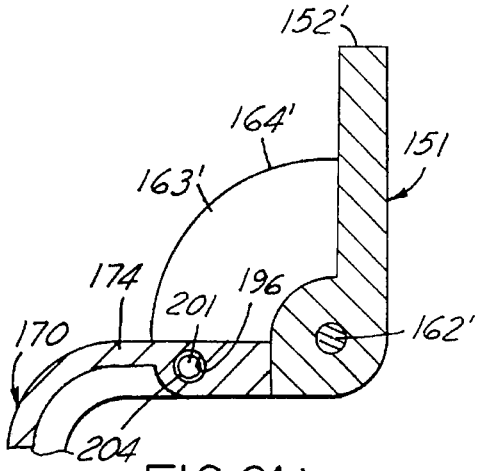
Figure 21:
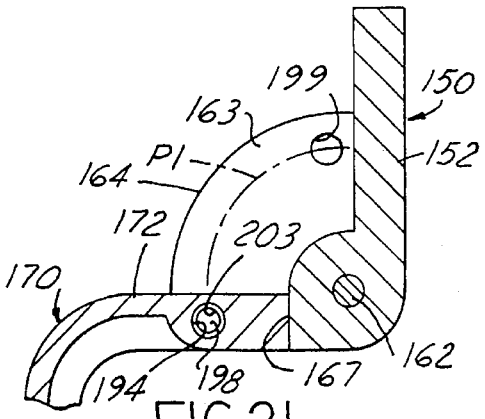
Figure 20:
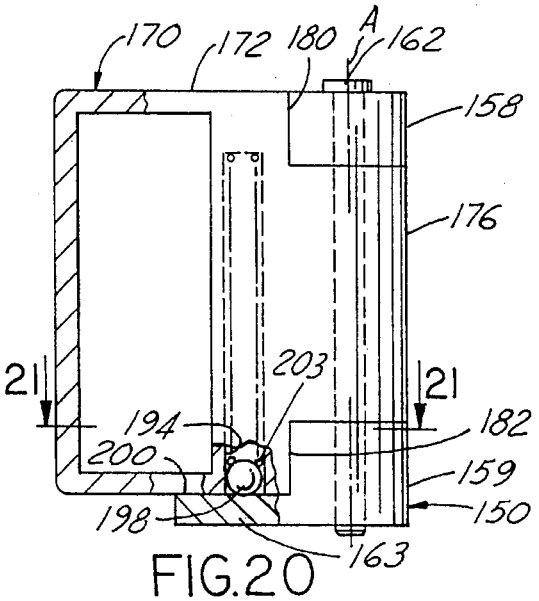
Figure 22:
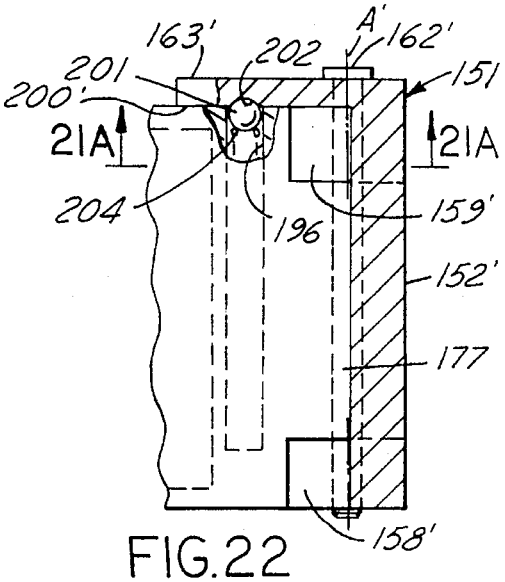

FIG, 6 is a view similar to FIG. 4 showing the upper hinge assembly in the door full open position;

FIG. 7 is an exploded perspective view of the double pivot hinge assembly shown in FIGS. 1–6;

FIG. 7A is a detail perspective view of the body hinge of FIG. 7;

FIG. 8 is a detail side view of the body hinge showing its internal face;

FIG. 9 is a horizontal sectional view taken on the line 9—9 of FIG. 5A;

FIG. 10 is a horizontal sectional view taken on the line 10—10 of FIG. 5B;

FIG. 11 is a detail end view of the body hinge of FIG. 8 taken in the direction of arrow "11";

FIG. 12 is a detail top view of the hinge assembly link with the link left half portion shown in horizontal section;

FIG. 13 is a detail side view, partly in vertical section, taken on the line 13—13 of FIG. 12;

FIG. 14 is a detail end view of the hinge assembly link of FIG. 13;

FIG. 15 is a front view of the hinge assembly of FIG. 7 in the direction of arrow "15" showing the parts assembled;

FIG. 16 is a side view of a van type vehicle showing a pair of closed side doors mounted thereon by a second embodiment of the double pivot hinges of the present invention;

FIG. 17 is an enlarged horizontal sectional view taken on the line 17—17 of FIG. 16 showing the lower hinge assembly in the door closed position;

FIG. 18 is a view similar to FIG. 17 showing the lower hinge assembly in the door intermediate open position;

FIG. 19 is a view similar to FIG. 16 showing the lower hinge assembly in the door full open position;

FIG. 20 is an enlarged vertical sectional view taken on the line 20—20 of FIG. 19;

FIG. 21 is an enlarged fragmentary horizontal sectional view taken of the line 21—21 of FIG. 20;

FIG. 21A is a view similar to FIG. 21 taken on the line 21A—21A of FIG. 22; and FIG. 22 is a fragmentary enlarged vertical sectional view taken on the line 22—22 of FIG. 19.

DETAILED DESCRIPTION OF THE INVENTION

Figure 1:
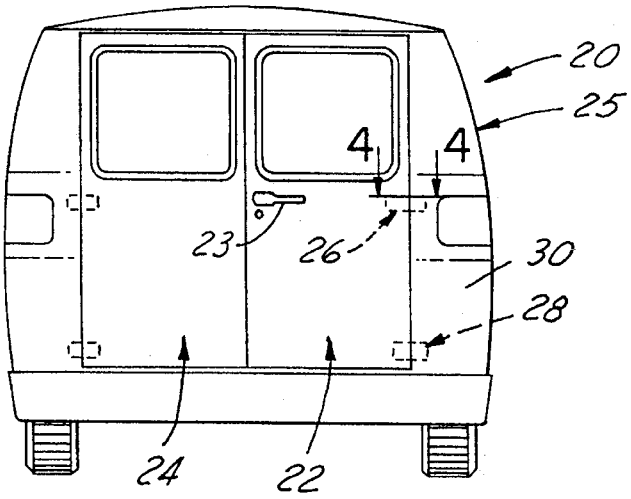
FIG. 1 is a rear view of a van type vehicle having a pair of doors mounted thereon by double pivot hinge assemblies in accordance with the present invention.
Figure 2:
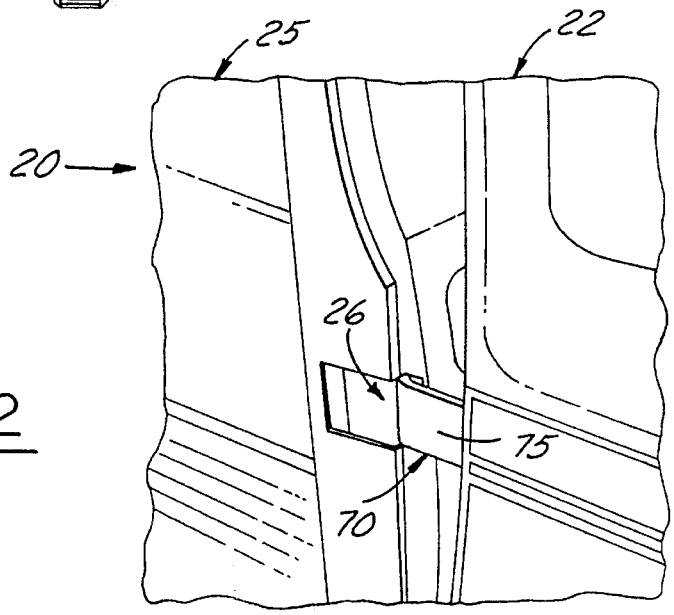
FIG. 2 is a fragmentary perspective view showing one rear door in its intermediate open position.
Figure 3:
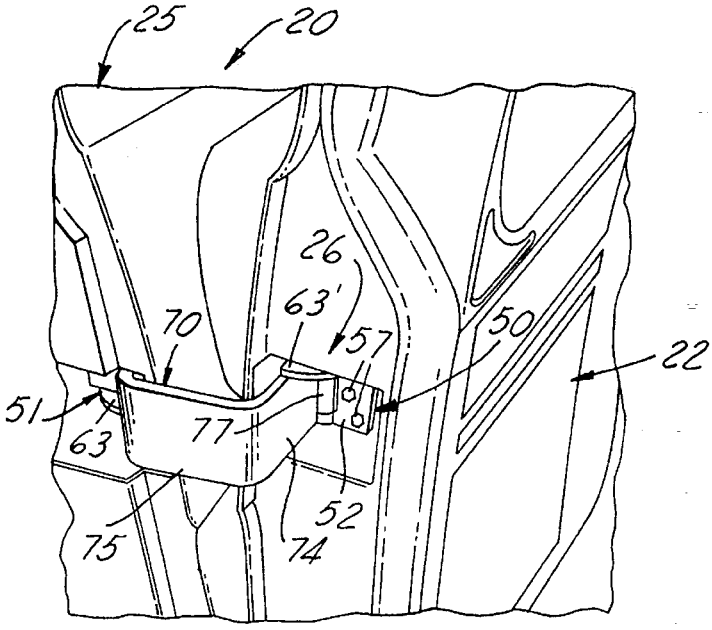
FIG. 3 is a view similar to FIG. 2 showing the door in its full open position.

Referring now to the drawings FIG. 1 illustrates a van or cargo type automotive vehicle 20 with right hand and left hand closed rear access doors 22 and 24. The right hand door 22 overlaps the left hand door 24 and is latched thereto when the doors are in their closed position. The overlapped left door 24 is releasably latched to the vehicle body 25 by a conventional latch mechanism operated by a latch handle 23. Each door is mounted to the vehicle body 25 by upper and lower double pivot hinge assemblies 26 and 28, respectively. As the hinge assemblies 26 and 28 are the same, only the upper hinge assembly 26 of the right hand door 22 will be described in detail in FIGS. 2 through 15 of the drawings.

FIG. 4 shows the vehicle body 25 providing an outer rear panel 30, co-planar or flush relation with door panel 31, and an inner rear panel 32 supported by a double-L shaped pillar 33 comprising a longitudinal pillar wall 34 extending rearwardly from a transverse pillar wall 35. The pillar wall 34 terminates in a transverse bight web 36 extending outboard from the pillar wall 34 while the transverse pillar wall 35 is shown terminating in a forwardly extending foot flange 36*a*. The transverse pillar wall 35 has a forwardly extending pillar return wall 37, extending in forwardly spaced parallel relation to the pillar longitudinal wall 34.

Again referring to FIG. 4, the pillar return wall 37 is shown in flush secured relation, as by welding, to one inboard surface of a longitudinal plate 38 of an obtuse-angled corner brace, indicated generally at 39. The corner brace 39 has a forward offset transverse lip 40 welded to the aft surface of inner panel laterally extending portion 32*a*. The return flange 37 is secured by an inner sloped flange 41 welded to outer sloped flange 42 of the corner pillar 39. The body outer rear panel 30 partially defines a rear door opening by an inwardly concave portion 43 of body shut face 44. The body shut face 44 is shown in opposed spaced relation to rear door shut face 45 which engages a compression door seal 46.

With reference to FIG. 7, the upper recessed hinge assembly 26 is shown comprising a body hinge 50 and a door hinge 51. As the hinges 50 and 51 are identical, except for the location of their associated detent pockets, the same reference numerals will be used in the following description with the exception that the reference numerals for the door hinge 51 are primed.

As best seen in FIG. 7, the body hinge 50 comprises a hinge leaf 52, provided with three bolt holes 53 with each hole countersunk at 54 in leaf face 55. FIG. 4 shows an opposite leaf face 56 secured by bolts 57 (FIG. 4) to an inboard opposed surface of pillar wall 34. The body hinge 52 includes upper and lower coaxially apertured ears 58 and 59 respectively, providing an upper ear bore 60 and a lower ear bore 61, aligned on pivot axis "A" (FIG. 7A) and adapted for receiving an associated hinge pin 62.

As best seen in FIG. 7A, the body-half hinge lower ear 59 is integrally formed with a fan-shaped ninety degree quadrant sector-plate 63 having an arcuate edge 64 with its center of curvature aligned on the hinge pin vertical axis "A". It will be noted in FIGS. 8–11 that the body hinge 50 has its upper leaf ear 58 formed with a blocking face 66 while its lower hinge plate ear 59 is formed with a blocking face 67. As seen in FIG. 11, the pair of blocking faces 66 and 67 are located in a common vertical plane indicated by dashed construction line "L" in FIG. 11. Further, as seen in FIGS. 8 and 10 and 11, the blocking faces 66 and 67 are each disposed in parallel off-set relation to their leaf face 55.

The hinge assembly 26 further comprises a generally U-shaped hinge link 70 formed with first 72 and second 74 parallel legs extending at right angles from each end of link connecting bight portion 75. The link leg 72 has an apertured single ear 76 adapted for insertion between its associated upper and lower body hinge leaf ears 58 and 59 while the link leg 74 has an apertured single ear 77 adapted for insertion between its associated upper and lower door hinge leaf ears 59' and 58'. Thus, the single link ear 76 is adapted for insertion between the body leaf upper and lower pair of ears 58 and 59 with ear bore 78 aligned with bores 60 and 61. In a corresponding manner the link single ear 77 is adapted for insertion between the door hinge upper and lower pair of ears 58' and 59' with link single ear bore 79 aligned with door hinge ear bores 60' and 61'.

It will be noted in FIGS. 7 and 13 that link leg 72 free distal end defining a pair of upper and lower stop faces 80 and 82 adapted to contact, in a flush manner, its associated body hinge upper and lower pair of ear blocking surfaces 66 and 67, respectively, upon the hinge link 75 and door 22 being rotated 90 degrees. In a corresponding manner FIG. 7 shows the link leg 74 free distal end defining a pair of upper and lower leg stop faces 84 and 86 adapted to contact associated door hinge upper and lower pair of blocking surfaces 67' and 66', respectively.

With reference to FIG. 7, it will be noted that each hinge link leg 72 and 74 includes resilient detent member latching devices 90 and 92, respectively. As seen in FIGS. 5A, 5B, 7, and 13, the link leg latching devices comprise vertically disposed blind bores 94 and 96, respectively, located a predetermined dimension from their associated leg free end stop faces 80,82 and 84,86. FIG. 5A shows a resilient detent member in the form of a lower spring-loaded steel latching ball 98 partially protruding from the lower open end of the leg 72 blind bore 94. The ball 98 is adapted to releasably latch or seat in a half-round detent pocket 99 formed in an upper raceway surface 100 of the sector plate 63. In a like manner, FIG. 7 shows an upper resilient detent member in the form of a spring-loaded steel latching ball 101 partially protruding from upper open end of the leg 74 blind bore 96. The ball 101 is adapted to releasably latch or seat in a half-round or substantially semi-spherical shaped detent pocket 102 (FIG. 5A).

FIG. 5A shows a coil spring 103 telescoped within the leg 72 blind bore 94 biasing the locking ball 98 downwardly into rolling or sliding contact on sector plate 63 opposed raceway surface 100. As seen in FIG. 9, the locking ball 98 is adapted to travel along an arcuate path "P", with its center of curvature on vertical hinge pin 62 axis "A", for releasable capture in detent pocket 99 upon pivoting the door 22 in a manner to be explained. With reference to FIG. 8A, there is shown a related view of the sector 63' wherein coil spring 104 in blind bore 96 of leg 74 biases the ball 101 upwardly into either rolling or sliding contact along arcuate path "P'" on sector 63' opposed raceway surface 100'. The arcuate path "P'" has its center of curvature aligned on vertical hinge pin axis "A'" for releasable locked capture in detent pocket 102.

Turning now to the operation of the double pivot hinge assembly 26, it will be seen that in the door 22 closed position of FIG. 4 the sector plate detent pocket 99 of body hinge 50 is not in latched engagement with its associated link spring loaded ball 98 while the door hinge sector plate detent pocket 99 is in latched engagement with its associated link spring loaded ball 101 (FIG. 5B). Thus, upon the door 22 being unlatched from the body by handle 23, the door 24 and hinge link are adapted to be rotated about body hinge pivot pin 162 to a predetermined self-latching ninety degree or intermediate hold-open position shown in FIG. 5. This results because the body hinge 50 is initially in its unlatched closed mode of FIG. 4, by virtue of its detent pocket 99 being located substantially 90 degrees from engagement by link spring loaded ball 98, while closed door hinge detent pocket 102 is latched to its associated link spring loaded ball 101.

As the door 22 and link 70 are rotated by the operator to their FIG. 5 position, the link spring loaded ball 98 is rotated substantially 90 degrees on body hinge raceway 100 into self-latching hold open engagement with body hinge detent pocket 99. At the FIG. 5 door intermediate hold-open position, it will be noted that the door hinge detent pocket 102 remains in latched engagement with its associated spring loaded ball 101. It will be further noted in FIG. 5, that upon the door 22 and hinge link 70 being pivoted to their intermediate position about pin 62, the link stop faces 80 and 82 are rotated into flush contact with their associated body hinge upper and lower blocking surfaces 66 and 67 preventing further counterclockwise rotation of the link 70 relative to the body hinge 50. Accordingly, the operator may continue rotating the door 22 causing the door hinge detent pocket 102 to cam the link spring-loaded ball 101 downwardly into its blind bore 96 in a self-unlatching manner allowing the door 22 to be rotated about the pivot pin 62' to a predetermined full hold-open position. It will be noted in FIG. 6, that the door hinge blocking surfaces 67' and 66' contact their associated link stop faces 84 and 86, thereby establishing a positive full hold-open position obviating the door contacting the vehicle body.

With reference to FIG. 6, the door 22 is shown pivoted to its full open position about pivot pin 62' as the body hinge upper and lower blocking surfaces 58 and 59 remain in contact with their associated link upper and lower stop faces 80 and 82, thereby preventing any counterclockwise door opening movement about pivot pin 62. With reference to the door full open position of FIG. 6, the door 22 is positively blocked against further rotation by virtue of its door hinge blocking surfaces 67' and 66' contacting their associated link leg stop faces 84 and 86. At the same time, it will be noted that the body hinge sector plate detent pocket 99 remains engaged with its associated spring loaded ball 98.

Upon the operator swinging the door 22 in clockwise rotation from its full-open position of FIG. 6 to its half-open or intermediate position of FIG. 5 about pivot pin 62', the door hinge sector plate detent pocket 102' is pivoted into self-latching engagement with upper spring-loaded ball 101 while door hinge leaf 52' is moved into flush contact with its associated link leg 74. During the closing of the door 22 from its full open FIG. 6 position to its intermediate hold-open FIG. 5 position, the body hinge detent pocket 99 remains engaged with its associated ball 98.

Upon the operator swinging the door 22, together with the link 70, about pin 62 from its FIG. 5 intermediate open position to its FIG. 4 door closed position, its spring-loaded ball 98 is commute upwardly into its blind bore 94 by its associated detent pocket 99 in a self-unlatching manner. It will be observed that the spring-loaded ball 98 is disengaged from body hinge pocket 99 because hinge leaf 52' is in flush engagement with its associated link arm 74, whereby the door 22, the door hinge 51, and the hinge link 70 are all pivoted in unison about the pin 62.

Referring to FIGS. 16 through 22, a second alternative arrangement of the double pivot hinge assembly of the present invention is shown installed on a pair of side doors of a vehicle. With reference to FIG. 16, there is illustrated a van-type vehicle 110 with a vehicle body 111 provided with a front passenger door 112, having a rear edge 113, and a pair of side doors 114 and 116 spaced rearwardly of the vehicle B-pillar 117. It will be noted that with the doors in their closed position, the forward side door 114 overlaps the aft side door 116 in a conventional manner while the doors are each latched to the vehicle body by a suitable latching mechanism having an exterior operating handle indicated generally at 118.

Each of the fore and aft side doors 114 and 116 are mounted to the vehicle body 110 by upper and lower double pivot hinge assemblies 126 and 128 respectively. As the hinge assemblies are the same, only the upper hinge assembly 126 of the forward side door 106 will be described in detail. Further, like or corresponding elements of the hinge assembly 126 and vehicle body structure will have the same reference numerals used in the description of FIGS. 1–15 except that they have been increased by one hundred.

FIG. 17 shows the vehicle body 110 provided with the "B" pillar 117 having a front shut face 120 in opposed relation to the aft shut face 122 of the front door 112. The B-pillar 117 has an inner body panel 132 supported by a double L-shaped vertical support member 133 comprising a transverse wall 134 extending outboard from a longitudinal pillar wall 135. The wall 134 terminates in a transverse bight 136 extending forward from the wall 134 while the longitudinal wall 135 is shown terminating in an inboard extending foot flange 136*a* welded to interior surface of "B" pillar shut face 144. The longitudinal pillar wall 135 has an inboard extending pillar return wall 137 in an inboard space parallel relation to the pillar wall 134.

As shown in FIG. 17, the pillar return wall 137 is in flush attached relation, as by welding, to one inboard surface of a plate 138 of an obtuse-angled corner brace indicated generally at 139. The corner brace has a inboard offset longitudinal lip 140 welded to the body panel portion 132*a*. The return flange 137 is secured by inboard angled flange 141 welded to an opposed angled flange 142 of the "B" pillar 117. The body side panel portion 130 partially defines a side door opening by an inwardly concave portion 143 in the body shut face 144. The pillar shut face 144 is shown in opposed space relation to the forward side door shut face 145 which engages a compression door seal 146.

With reference to the operation of the double pivot hinge assembly 126, the sector plate 163 of the body hinge 150 has its detent pocket 199 (FIG. 19) engaged with its associated spring-loaded ball 198 of link arm 172 with the side doors in their FIG. 17 closed positions. Also, the sector plate 163' of the door hinge 151 has its detent pocket 202 disengaged with its associated spring-loaded ball 201 (FIG. 22). The side door 114 is swung to its intermediate hold-open position of FIG. 18 by virtue of the door hinge 151 pivoting substantially 90 degrees about its hinge pin 162'. The door hinge 151 is adapted to pivot because its sector plate detent pocket 202 is disengaged from its associated spring-loaded ball 201 while the body hinge detent pocket 199 is engaged with its associated spring-loaded ball 198.

It will be noted in FIG. 5 that upon rotating the rear door 22 to its 90 degree hold-open position, the body hinge 50 pivots about its hinge pin 62 because its sector plate detent pocket 99 is engaged by link leg spring-loaded ball 98. In the case of the side door 106, however, it will be seen in FIG. 18 that it is desirable to provide a predetermined clearance dimension "D" between exterior panel 131 of intermediate hold-open side door 114 and front passenger door rear edge 113. By merely reversing the location of the detent pocket 198 in the body hinge segment plate 163 with the location of the detent pocket 202 in the door hinge segment plate 163', applicants' hinge assembly 126 provides an adequate clearance "D" wherein the side door panel 131 is adapted to clear the front passenger door rear edge 113 in the case where the passenger door 112 has already been rotated to its 90 degree open position.

In FIG. 19, the side door 114 is shown rotated from its 90 degree hold-open position to its 180 degree open position by rotating the link 170 about body hinge pivot pin 162 upon the link spring-loaded ball 198 self-unlatching itself from the body hinge detent pocket 199. The door 114 has a substantially 90 degree arc limit of rotation from its FIG. 18 intermediate open position to its full-open position of FIG. 19 because the door-hinge 151 blocking surfaces 166 and 167 contact their associated link leg 172 stop faces 180 and 182. It will be noted in FIG. 19 that with both the body hinge 150 and the door hinge 151 blocked against further opening rotation, the side door 114 is prevented from contacting the closed front passenger door 112.

Upon closing the side door 114 from its 180 degree open position of FIG. 19 to its 90 degree open position of FIG. 18, the body hinge 150 rotates 90 degrees about its pivot pin 162 wherein its spring-loaded ball 198 moves through an arc of substantially 90 degrees on raceway surface 200 of its sector plate 163 into self-latching engagement with its associated detent pocket 199.

With reference to FIG. 18, upon the camped swinging of the side door 114 from its 90 degree open position to its door closed position of FIG. 17, the door hinge 151 rotates substantially 90 degrees about its pivot pin 162'. It will be appreciated that a predetermined minimal clockwise force by the operator on the door is sufficient to unseat the spring-loaded ball 201 from its associated detent pocket 202. The spring-loaded ball 202 moves through an arc of substantially 90 degrees on raceway 200' of door hinge sector plate 163' to its FIG. 17 position wherein an exterior surface of link leg 172 contacts opposed interior surface of the body hinge leaf 152.

Obviously, many variations and modifications of the present invention are possible in light of the above teachings. It is, therefore, to be understood that within the scope of the appended claims, the invention may be practiced otherwise than as specifically described.

What is claimed is:

1. A double pivot hinge assembly for attaching a door to a vehicle body door frame for swinging movement between closed, intermediate open, and full open positions, said hinge assembly comprising:

a U-shaped hinge link having a bight portion and first and second legs extending therefrom, said first leg having an end, said second leg having an end, a first pin pivotally connecting a body hinge to said end of said first leg and a second pin pivotally connecting a door hinge to said end of said second leg;

said body hinge having a horizontally disposed raceway further comprising a detent pocket;

said door hinge having a horizontally disposed raceway further comprising a detent pocket;

said first leg further comprising a resilient detent member juxtaposed against said body hinge raceway and adapted for biased travel along a predetermined arc;

said second leg further comprising a resilient detent member juxtaposed against said door hinge raceway and adapted for biased travel along a predetermined arc;

said first leg detent member adapted to cooperate with said body hinge detent pocket in either a self-latching or self-unlatching manner upon predetermined door rotation;

said second leg detent member adapted to cooperate with said door hinge detent pocket in either a self-latching or self-unlatching manner upon predetermined door rotation;

said first leg end having a stop face;

said second leg end having a stop face;

said body hinge having a blocking surface;

said door hinge having a blocking surface;

said first leg end stop face adapted for contact with said body hinge blocking surface upon predetermined door rotation;

said second leg end stop face adapted for contact with said door hinge blocking surface upon predetermined door rotation;

whereby upon the door being rotated from a closed position to an intermediate open position, said body hinge detent pocket is adapted to cooperate with said first leg resilient detent member in a self-latching manner, said door hinge detent pocket is adapted to cooperate with said second leg resilient detent member in a self-unlatching manner, and wherein said body hinge blocking surface moves into contact with said first leg end stop face.

2. The double pivot hinge assembly as set forth in claim 1 whereby upon the door being rotated from its intermediate open position to its full open position, said door hinge detent pocket is moved from its latched mode with said second leg detent member to an un-latched mode, and wherein said door hinge blocking surface comes into contact with said second leg end stop face.

3. The double pivot hinge assembly as set forth in claim 2 wherein upon the door being rotated from its full open position to its intermediate open position said door hinge detent pocket is moved from its un-latched mode to its latched mode with said second leg end detent member, and wherein said door hinge blocking surface is rotated out of contact with said second leg stop face, and, wherein, upon the door being moved from its intermediate open position to its closed position, said body hinge detent pocket is moved from its latched mode to its un-latched mode, and wherein said body hinge blocking surface is rotated out of contact with said first leg end stop face.

4. The double pivot hinge assembly as set forth in claim 1 wherein said body hinge raceway is defined by one horizontal surface of a segment plate secured to a lower portion of said body hinge, said segment plate having one radial side edge disposed normal to said first leg and one side edge disposed parallel to said first leg defining a substantially 90 degree angle therebetween, said segment plate formed with an arcuate edge having its center of curvature located on said body hinge pin axis.

5. The double pivot hinge assembly as set forth in claim 4 wherein said body hinge detent pocket is located adjacent a juncture of said segment plate parallel side edge and said arcuate edge with said body hinge in its door closed position.

6. The double pivot hinge assembly as set forth in claim 1 wherein said door hinge raceway is defined by one horizontal surface of a segment plate secured to an upper portion of said door hinge, said segment plate having one radial side edge disposed normal to said second leg and one side edge disposed parallel to said second leg, defining a substantially 90 degree angle therebetween, said door segment plate formed with an arcuate edge having its center of curvature located on said body hinge pin axis.

7. The double pivot hinge assembly as set forth in claim 6 wherein said door hinge segment plate horizontal surface is formed with said detent pocket located in overlying relation to said second leg with said door hinge in its door closed position.

8. The double pivot hinge assembly as set forth in claim 1 wherein with the door in its closed position said body hinge has a body hinge leaf defining an exterior surface fixed to the body and an interior surface adapted for contact with an exterior surface of said link first leg and said door hinge has a door hinge leaf defining an exterior surface fixed to the door and an interior surface adapted for contact with an exterior surface of said second leg;

said first link leg end having an ear intermeshed with upper and lower ears on one end of said body hinge leaf.

9. The double pivot hinge assembly as set forth in claim 8 wherein said body hinge leaf has upper and lower ears, said first link leg has an intermediate ear intermeshed between said body hinge leaf upper and lower ears, said door hinge leaf has upper and lower ears, and said second link leg has an intermediate ear intermeshed between said door hinge leaf upper and lower ears.

10. The double pivot hinge assembly as set forth in claim 1 wherein the door is a right hand door of a pair of side-by-side rear doors of a vehicle, said hinge link having a first outboard leg and a second inboard leg, wherein said first outboard leg is adjacent an aft right-hand rounded body corner of the vehicle, and said outboard leg is a predetermined dimension shorter than said inboard leg allowing said hinge assembly to be in recessed flush relative to an exterior adjacent surface of the vehicle.

11. The double pivot hinge assembly as set forth in claim 1 wherein said first leg detent member is in the form of a vertically disposed bore with a bore open end in a horizontal edge of said first leg juxtaposed against said body hinge raceway, a spring-loaded latch ball in said bore adapted for biased travel along a predetermined arcuate path on said body hinge raceway, said latch ball being axially extendable to permit releasable engagement with said body hinge detent pocket upon predetermined relative rotation between each said link and said body hinge, and wherein said second leg detent member is in the form of a vertically disposed bore with a bore open end in a horizontal edge of said second leg juxtaposed against said door hinge raceway, a spring-loaded latch ball in said bore adapted for biased travel along a predetermined arcuate path on said door hinge raceway, said latch ball being axially extendable to permit releasable engagement with said door hinge detent pocket upon predetermined relative rotation between each said link and said door hinge.

12. The double pivot hinge assembly as set forth in claim 1 wherein each said detent pocket is in the form of a semi-circular pocket.

13. A double pivot hinge assembly for attaching a door to a vehicle body door frame for swinging movement between closed, 90 degree hold open, and 180 degree open positions, said hinge assembly comprising:

a U-shaped hinge link having a bight portion and first and second parallel legs extending therefrom, a first hinge pin pivotally connecting a body hinge to a distal end of said link first leg and a second hinge pin pivotally connecting a door hinge to a distal end of said link second leg;

said body hinge having a leaf adapted for contact with said link first leg and said door hinge having a leaf adapted for contact with said second leg, whereby with the door in a closed position said body hinge leaf contacting said link first leg and said door hinge leaf contacting said link second leg;

said body hinge having a horizontally disposed raceway formed with a detent pocket, said door hinge having a horizontally disposed raceway formed with a detent pocket, said first link leg having a vertically disposed bore enclosing a spring-loaded ball therein, said second leg having a vertically disposed bore enclosing a spring-loaded ball therein, said first leg ball biased into contact with said body hinge raceway and adapted for arcuate biased travel thereon about the pin axis of said body hinge for predetermined self-latching with said body hinge detent pocket during rotation of the door in one direction and predetermined self-unlatching with said body hinge detent pocket upon rotation of the door in the opposite direction; said second leg ball biased into contact with said door hinge raceway and adapted for arcuate biased travel thereon about the pin axis of said door hinge for predetermined self-latching with said door hinge detent pocket during rotation of the door in one direction and predetermined self-unlatching with said door hinge detent pocket upon rotation of the door in the opposite direction;

said body hinge formed with a blocking surface adapted for contact with a stop face on said first link leg distal end upon relative rotation about said body hinge pin from a door closed position to a door 90 degree open position or from a door 90 degree open position to a door 180 degree open position; and said door hinge formed with a blocking surface adapted for contact with a stop face on said second link leg distal end upon relative rotation about said door hinge pin from a door closed position to a door 90 degree open position or from a door 90 degree open position to a door 180 degree open position.

14. The double pivot hinge assembly as set forth in claim 13 wherein upon the door, in the form of a rear access door, being swung from its closed position to its 90 degree open position, said U-shaped link is rotated 90 degrees about said body hinge pin, wherein said link first leg spring-loaded ball travels substantially 90 degrees on said body hinge raceway such that said ball engages said body hinge detent pocket thereby releasably latching the door in a 90 degree hold-open position.

15. The double pivot hinge assembly as set forth in claim 13 wherein upon the door, in the form of a side access door, being swung from its closed position to its 90 degree open position, said side door hinge rotates substantially 90 degrees about said door hinge pin, wherein said link second leg spring-loaded ball travels substantially 90 degrees on said door hinge raceway such that said ball adapted for self-latching with said door hinge detent pocket thereby releasably retaining the side door in a 90 degree hold-open position.

16. The double pivot hinge assembly as set forth in claim 13 wherein the rear access door being swung from its 90 degree open position to its 180 degree open position whereby said link second leg spring-loaded ball is adapted for self-unlatching from said door hinge detent pocket and rotating substantially 90 degrees on said door hinge raceway wherein one or more blocking surfaces on said door hinge engage one or more stop faces on said link second leg obviating the rear door contacting adjacent portions of the vehicle body.

17. The double pivot hinge assembly as set forth in claim 13 wherein upon the side access door being rotated in one direction from its 90 degree open position to its 180 degree open position, said link first leg spring-loaded ball self-unlatches said body hinge detent pocket and rotates substantially 90 degrees on said body hinge raceway wherein blocking surfaces on said body hinge engaging stop faces on said link first leg whereby the door is positively limited from further rotation in said one direction and is adapted to be rotated only in an opposite door closing direction.

* * * * *